US008549734B2

(12) United States Patent
Yeon

(10) Patent No.: US 8,549,734 B2
(45) Date of Patent: Oct. 8, 2013

(54) METHOD FOR MANUFACTURING SEALED CONTACTOR

(75) Inventor: Young Myoung Yeon, Chungcheongbuk-Do (KR)

(73) Assignee: LSIS Co., Ltd., Anyang-Si, Gyeonggi-Do (KR)

( * ) Notice: Subject to any disclaimer, the term of this patent is extended or adjusted under 35 U.S.C. 154(b) by 159 days.

(21) Appl. No.: 13/273,155

(22) Filed: Oct. 13, 2011

(65) Prior Publication Data

US 2012/0090149 A1 Apr. 19, 2012

(30) Foreign Application Priority Data

Oct. 15, 2010 (KR) ..... 10-2010-0100778

(51) Int. Cl.

| | |
|---|---|
| ***H01H 11/00*** | (2006.01) |
| ***H01H 11/02*** | (2006.01) |
| ***H01H 11/04*** | (2006.01) |
| ***H01H 65/00*** | (2006.01) |

(52) U.S. Cl.

USPC ..... 29/622; 29/592.1; 29/602.1; 218/68; 218/118; 335/131; 335/151; 335/154

(58) Field of Classification Search

USPC ..... 29/426.1, 428, 469, 521, 524.1, 525.06, 29/592.1; 218/68, 118–126, 155–157; 174/68.2, 68.3, 70 B, 71 B, 72 B, 88 B, 174/99 B, 129 B, 133 B, 149 B; 335/131, 335/151–154, 185, 194, 201, 248, 252; 361/605, 611, 648, 649

See application file for complete search history.

(56) References Cited

U.S. PATENT DOCUMENTS

| | | | | |
|---|---|---|---|---|
| 5,892,194 | A * | 4/1999 | Uotome et al. | 218/68 |
| 7,876,183 | B2 * | 1/2011 | Uruma et al. | 335/126 |
| 2005/0146405 | A1 * | 7/2005 | Nishida et al. | 335/132 |

FOREIGN PATENT DOCUMENTS

| | | | |
|---|---|---|---|
| EP | 0798752 | | 10/1997 |
| EP | 1953784 | | 8/2008 |
| JP | 64-52348 | | 2/1989 |
| JP | 8-212860 | | 8/1996 |
| JP | 09-320411 | | 12/1997 |
| JP | 10188711 | A * | 7/1998 |
| JP | 11232986 | A * | 8/1999 |
| JP | 11238443 | A * | 8/1999 |
| JP | 2001-093390 | | 4/2001 |

(Continued)

OTHER PUBLICATIONS

Japan Patent Office Application U.S. Appl. No. 2011-225773, Office Action dated Mar. 5, 2013, 3 pages.

(Continued)

*Primary Examiner* — Paul D Kim

(74) *Attorney, Agent, or Firm* — Lee, Hong, Degerman, Kang & Waimey

(57) ABSTRACT

A method for manufacturing a sealed contact point is performed by injecting an arc extinguishing gas into an air-tight space of an electromagnetic switching device and sealing it. The method for manufacturing a sealed contactor, including: forming a driving body and coupling a housing and a plate; air-tightly fixing a detachable chamber and forming the interior of the chamber under an insulating gas atmosphere; tightly attaching the cylinder to the plate by a tight-attachment inducing member within the chamber under the insulating gas atmosphere to form a sealing structure; exhausting the chamber; disassembling the chamber from the plate; and sealing the tightly attached plate and the cylinder.

12 Claims, 6 Drawing Sheets

(56) References Cited

FOREIGN PATENT DOCUMENTS

| | | | |
|---|---|---|---|
| JP | 2002-075108 | | 3/2002 |
| JP | 2002-216603 | | 8/2002 |
| JP | 2003100190 A | * | 4/2003 |
| JP | 2005-183278 | | 7/2005 |
| JP | 2006261056 A | * | 9/2006 |

OTHER PUBLICATIONS

Japan Patent Office Application Serial No. 2011-225773, Office Action dated Jul. 2, 2013, 3 pages.

* cited by examiner

METHOD FOR MANUFACTURING SEALED CONTACTOR

CROSS-REFERENCE TO RELATED APPLICATION

This application claims the benefit of Korean Patent Application No. 10-2010-0100778, filed on Oct. 15, 2010 which are hereby incorporated by reference for all purposes as if fully set forth herein.

BACKGROUND OF THE INVENTION

1. Field of the Invention

The present invention relates to a method for manufacturing a sealed contactor of an electromagnetic switching device and, more particularly, to a method for manufacturing a sealed contactor by injecting an arc extinguishing gas into an air-tight space of an electromagnetic switching device and sealing it.

2. Description of the Related Art

In general, in a hybrid automobile, a fuel-cell automobile, or an electric automobile such as a golf cart and an electric forklift, or the like, an electronic switching device for opening and closing DC power is installed between a storage battery and a DC power conversion device to supply DC power from the storage battery into the DC power conversion device or cut off power supply to the DC power conversion device.

Also, in an environment-friendly developing system such as a photovoltaic system, a wind power generation system, or the like, the electromagnetic switching device for opening and closing DC power is installed between a DC generator and an inverter which converts DC generation power into AC power of a commercial frequency and voltage to serve to supply DC generation power to the inverter or cut off DC generation power.

The electromagnetic switching device may be configured to include a fixed contact point and a movable contact point and an actuator for driving the movable contact point such that the contact points can be controlled.

In particular, in the electromagnetic switching device for opening and closing DC power, used for an electric automobile, when the movable contact point is instantly released from the fixed contact point, namely, the contact point in an OFF state, an arc may be generated, and in order to quickly extinguish arc, the space in which the contact points are disposed is required to be configured to be air-tight and the air-tight space is required to be filled with an arc extinguishing gas.

In order to allow an electronic component to maintain a life span of a certain level or longer and reliable functions thereof, the arc extinguishing gas is required to be maintained by a certain level or higher in the air-tight space, and to this end, a technique for sealing the arc extinguishing gas is required.

SUMMARY OF THE INVENTION

An aspect of the present invention provides a method for manufacturing a sealed contactor of an electromagnetic switching device capable of sealing a space which may be filled with an arc extinguishing gas in order to extinguish an arc generated when a contact point is in an OFF state.

Another aspect of the present invention provides a method for sealing a space without using sub-materials in forming an air-tight space of an electromagnetic switching device.

According to an aspect of the present invention, there is provided a method for manufacturing a sealed contactor, including: forming a driving body by coupling a movable contact point, a shaft, and a core, and coupling a housing and a plate to form an air-tight space in which a fixed contact point and a movable contact point are disposed; air-tightly fixing a detachable chamber to a lower portion of the plate and forming the interior of the chamber under an insulating gas atmosphere; inserting the shaft and core of the driving body protruded from a lower portion of the plate into a cylinder within the chamber under the insulating gas atmosphere and tightly attaching the cylinder to the plate by a tight-attachment inducing member mounted at a lower portion of the plate to form a sealing structure; exhausting the chamber; disassembling the chamber from the plate; and sealing the tightly attached plate and the cylinder.

In coupling the housing and the plate, the housing, a connection body fixing the housing, and the plate may be coupled to the form the sealing structure.

In forming the interior of the chamber under an insulating gas atmosphere, the detachable chamber may be air-tightly fixed to the lower portion of the plate in a state in which the protruded shaft and the core of the driving body are exposed, and an insulating gas is injected into the chamber in a vacuum state at a certain pressure.

The insulating gas may be hydrogen ($H_2$) or a mixture of hydrogen ($H_2$) and nitrogen ($N_2$).

In forming the interior of the chamber under the insulating gas atmosphere, the insulating gas may be injected by using a gas pump connected to the chamber. In this case, in forming the interior of the chamber under the insulating gas atmosphere, the interior of the chamber may be exhausted to be vaccumized by the gas pump and then the insulating gas may be injected into the chamber.

In coupling the cylinder, within the chamber under the insulating gas atmosphere, the shaft and the core protruded from the lower portion of the plate may be inserted into the cylinder, and the tight-attachment inducing member mounted on the plate and a surface protrusion formed on the cylinder may be tightly attached to form a sealing structure.

The tight-attachment inducing member may have a form of a circular rubber ring, and a plurality of tight-attachment inducing members may be provided at a portion where the cylinder can be coupled to the plate.

In disassembling the chamber, in a state in which the plate and the cylinder are tightly attached and coupled, the insulating gas may be discharged from the chamber under the insulating gas atmosphere, and the chamber air-tightly fixed to the plate may be then disassembled.

In the sealing, the plate and the cylinder may be laser-welded in a state in which the chamber is disassembled.

The foregoing and other objects, features, aspects and advantages of the present invention will become more apparent from the following detailed description of the present invention when taken in conjunction with the accompanying drawings.

DETAILED DESCRIPTION OF THE INVENTION

An electromagnetic switching device according to an embodiment of the present invention will be described in detail with reference to the accompanying drawings.

Figure 1:
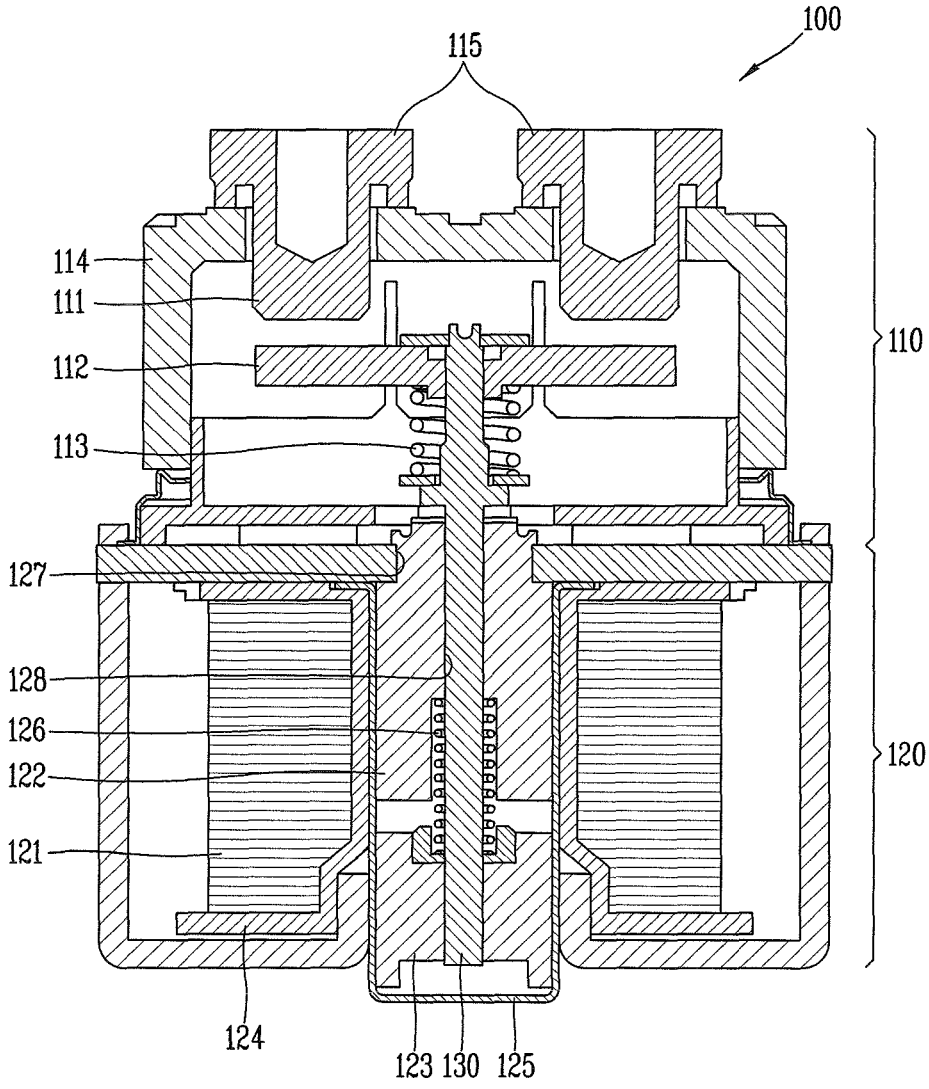
FIG. 1 is a view showing an electromagnetic switching device according to an embodiment of the present invention.

FIG. 1 is a view showing an electromagnetic switching device according to an embodiment of the present invention. With reference to FIG. 1, the electromagnetic switching device 100 includes an arc extinguishing unit 110 and a driving unit 120.

The arc extinguishing unit 110 includes a fixed contact point 111 and a movable contact point 112 to have a contact point opening and closing structure to perform switching on an external device connected to the electromagnetic switching device 100.

The driving unit 120 includes an actuator for controlling opening and closing of contact points by using an electrical signal. The electromagnetic switching device 100 switches an external device connected with the electromagnetic switching device 100 according to a vertical motion of the driving unit 120 through the actuator.

The driving unit 120 includes an excitation coil 121 generating magnetic force by an electrical signal to generate a driving force of a contact point, a fixed iron core 122 fixedly disposed within the excitation coil 121, and a movable iron core 123 disposed to face the fixed iron core 122. The fixed iron core 122 and the movable iron core 123 may be called a core.

A coil bobbin 124 around which the excitation coil 121 is wound is provided between the excitation coil 121 and the fixed iron core 122 and the movable iron core 123, and the fixed iron core 122 and the movable iron core 123 are disposed along an axial direction of the coil bobbin 124. The fixed iron core 122 and the movable iron core 123 form a magnetic path through which magnetic flux generated by the excitation coil 121 passes. The movable iron core 123 has driving force of moving in a vertical direction by the magnetic flux generated by the excitation coil 121.

A plunger cap or cylinder 125 is formed between the coil bobbin 124, the fixed iron core 122, and the movable iron core. The plunger cap or cylinder 125 is made of a nonmagnetic material and has a cylindrical shape. The side, of the plunger cap or cylinder 125, at the side of the arc extinguishing unit 110 is open and the other side thereof is closed.

The plunger cap or cylinder 125 has a shape of a container in which the fixed iron core 122 and the movable iron core 123 are received, and the fixed iron core 122 and the movable iron core 123 are formed to have a cylindrical shape, and the outer diameter of the fixed iron core 122 and that of the movable iron core 123 have the substantially same diameter as the inner diameter of the plunger cap 125. The movable iron core 123 may be movable in an axial direction of the plunger cap 125.

A movement range of the movable iron core 123 may be determined between a joining position at which one side of the movable iron core 123 is joined to the fixed iron core 122 and an initial position at which the other side of the movable iron core 123 is separated from a bottom face of the plunger cap 125. The joining force joining the movable iron core 123 to the fixed iron core 122 is provided by an electromagnetic pulling power formed by the excitation coil 121, and spring power in a direction in which the movable iron core 123 is returned to its initial position is provided by a return spring 126.

A fastening hole 127 allowing a portion of the fixed iron core 122 to be inserted to pass therethrough is formed at a central portion of the driving unit 120. The fixed iron core 122, in a state of being inserted in the fastening hole 127, is fixed in the driving unit 120.

The movable iron core 123 is provided at the central portion of the driving unit 120, and becomes closed to or away from the fixed iron core 122. A guide for guiding a motion of the movable iron core 123 may be provided at an inner side of the core bobbin 124 of the central portion.

A through hole 128 is formed at a central portion of the fixed iron core 122 and the movable iron core 123, and a shaft 130 is disposed in the through hole 128 through the arc extinguishing unit 110 and the driving unit 120. The shaft 130 is disposed to penetrate through the through hole 128 in an axial direction. The movable contact point 112 is coupled to an upper end of the shaft 130 and movable iron core 123 is coupled to a lower end of the shaft 130, so the shaft 130 transfers a vertical motion of the movable iron core 123 to the movable contact point 112.

A housing 114 having a box-like shape with an open lower portion is installed on an upper portion of the driving unit 120. The housing 114 includes terminal holes formed at an upper portion thereof, and the fixed contact points 111 and fixed terminals 115 are inserted through the terminal holes.

The movable contact point 112 is disposed below the fixed contact points 111 within the housing. The movable contact point 112 is coupled with the shaft 130 and is brought into contact with the fixed contact point 111 and separated from the fixed contact point 111 for a switching operation.

A contact spring 113 is provided below the movable contact point 112 in order to provide elastic force when the movable contact point 112 is brought into contact with the fixed contact point 111. Through the contact spring 113, the movable contact point 112 can be maintained in a state of being in contact with the fixed contact point 111 by a certain pressure or higher. Also, when the movable contact point 112 is separated from the fixed contact point 111, the contact spring 113 reduces a motion speed of the movable iron core 123 and the shaft 130, thereby reducing impact force when the movable iron core 123 is brought into contact with the plunger cap 125, thus restraining generation of noise and vibration.

Figure 2A:
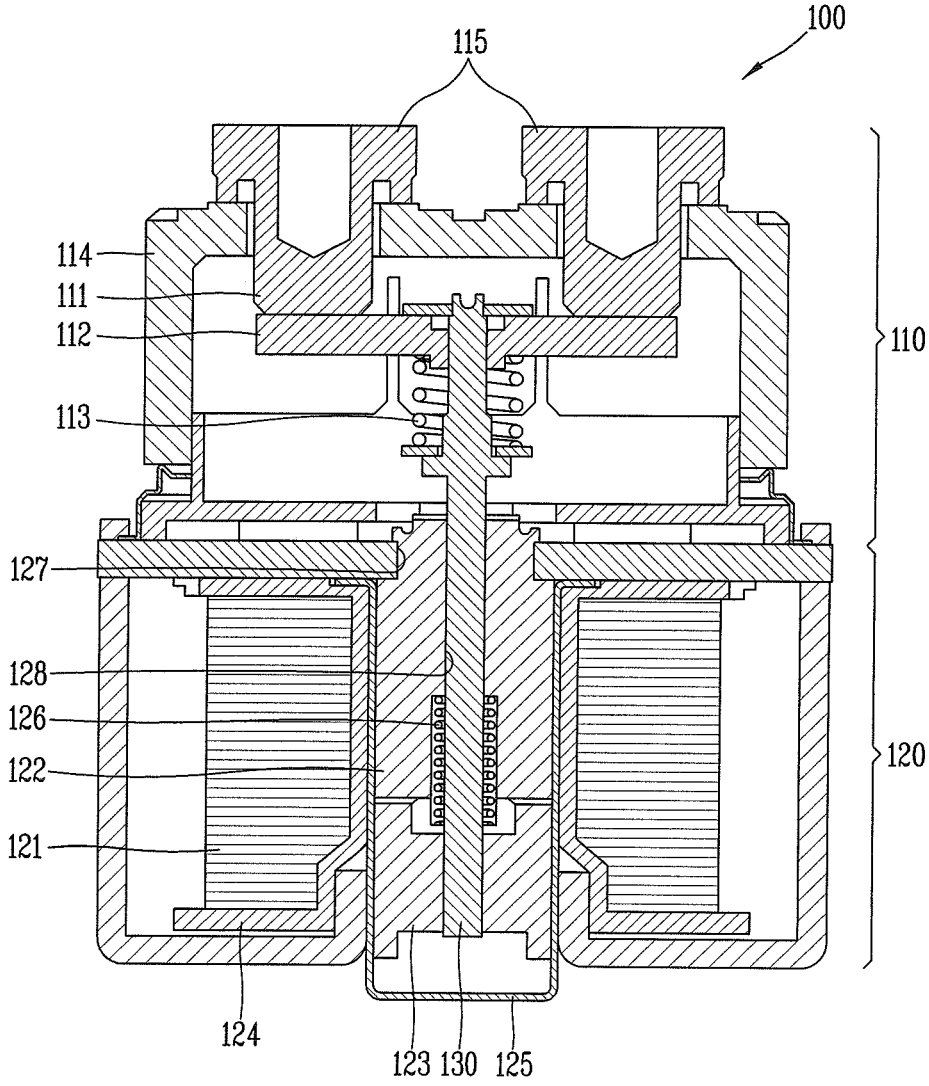
FIGS. 2A and 2B are views showing a switching state of the electromagnetic switching device according to an embodiment of the present invention.
Figure 2B:
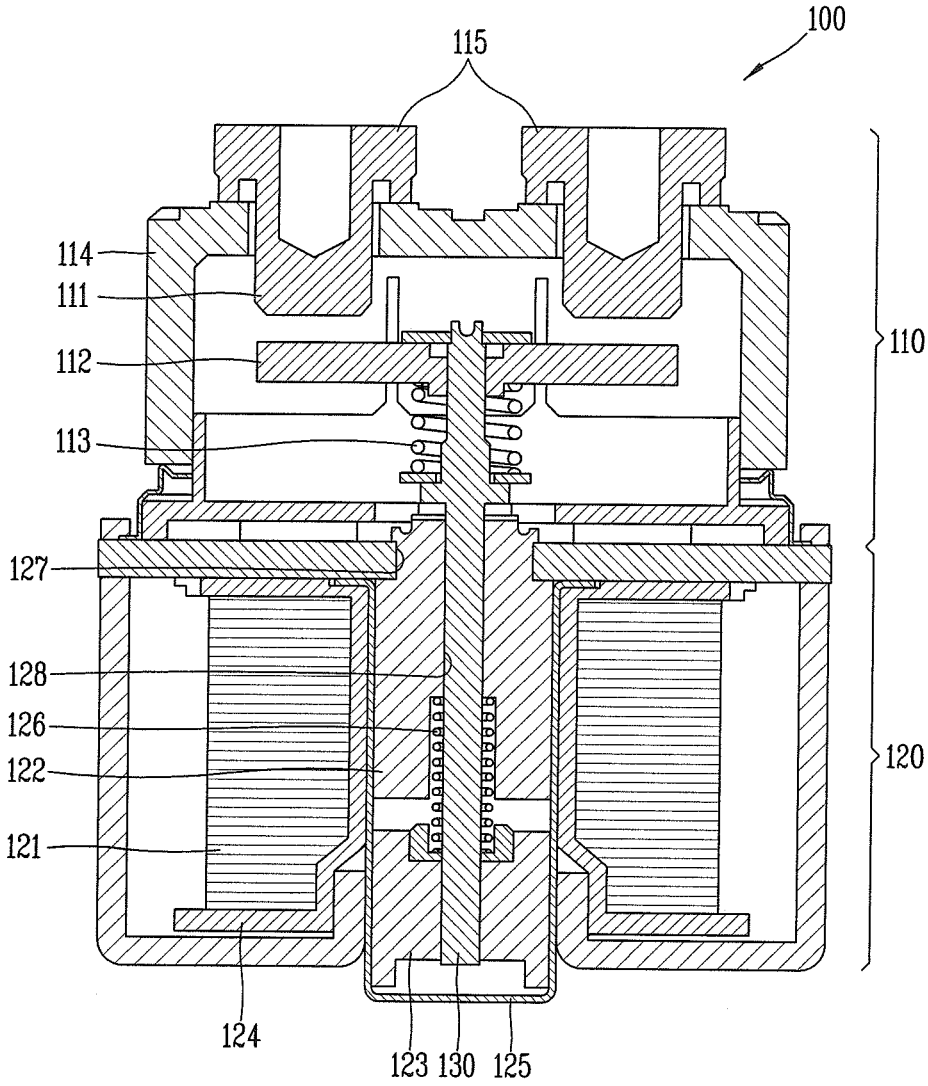

FIGS. 2A and 2B are views showing a switching state of the electromagnetic switching device according to an embodiment of the present invention. Specifically, FIG. 2A shows a closed state of the electromagnetic switching device and FIG. 2B shows an open state of the electromagnetic switching device.

According to the structure illustrated in FIG. 1, when a current flows to the excitation coil 121, a magnetic flux is generated in the vicinity of the excitation coil 121. According to this magnetic flux, the fixed iron core 122 and the movable iron core 123 are magnetized such that the mutual facing sides have different polarities. Accordingly, the movable iron core 123 is absorbed to the fixed iron core 122, so they are in contact with each other. When the movable iron core 123 is at the joining position with the fixed iron core 122, the fixed contact point 111 and the movable contact point 122 are in contact with each other. When the fixed contact point 111 and the movable contact point 112 are in contact, power is supplied to an external device, and this state is the closed state of FIG. 2A.

Also, when the excitation coil 121 is shorted, generation of the magnetic force of the excitation coil 121 is stopped and the driving force of the movable iron core 123 is lost, so the movable iron core 123 is returned to its initial position by the elastic force of the return spring 126. Immediately when the movable iron core 123 is returned to its initial position, the shaft 130 is moved and the movable contact point 112 is separated from the fixed contact point 111.

Here, the return spring 126 is accommodated in a spring receiving recess 201 installed at the fixed iron core 122. When the movable iron core 123 is in the closed state (i.e., when the movable iron core 123 has been moved to be at the joining position), the return spring 126 is compressed to be entirely accommodated in the spring receiving recess 201, so the return spring 126 is not an obstacle interfering with the coupling of the movable iron core 123 to the fixed iron core 122. When the movable iron core 123 is returned to its initial position, power supply to the external device is stopped, and this state is the open state of FIG. 2B.

The electromagnetic switching device switches the external device by repeatedly performing the closed state of FIG. 2A and the open state of FIG. 2B.

Figure 3:
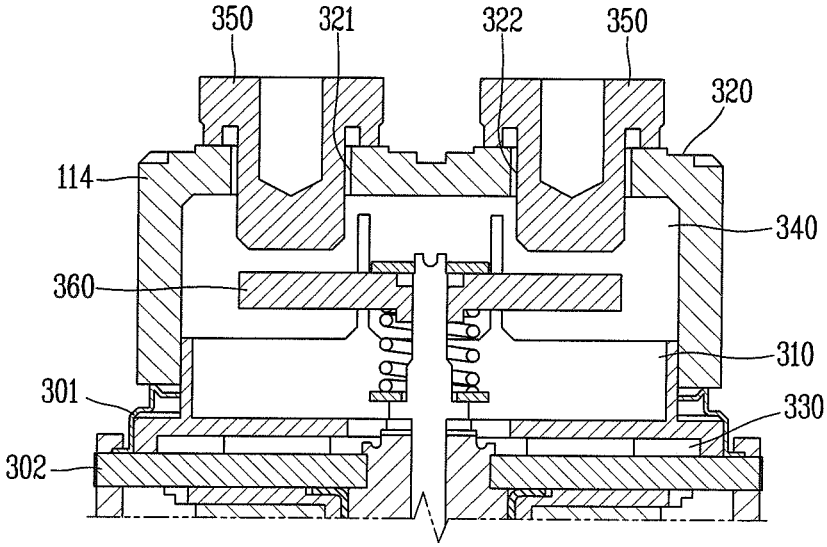
FIG. 3 is a view showing an air-tight space into which an arc extinguishing gas is injected in the electromagnetic switching device according to an embodiment of the present invention.

FIG. 3 is a view showing an air-tight space into which an arc extinguishing gas is injected in the electromagnetic switching device according to an embodiment of the present invention.

With reference to FIG. 3, in order to accommodate the arc extinguishing unit 110, the fixed iron core 122, and the movable iron core 123 in an air-tight space, the housing 114, a connection body 301, an upper plate 302, and the plunger cap 125 are installed and air-tightly joined. Namely, the space encompassed by the housing 114, the connection body 301, the upper plate 302, and the plunger cap 125 is formed to be air-tight.

The housing 114 is made of a heat-resistant material such as ceramic, or the like, and has a box-like shape. An opening 310 is formed at a lower portion of the housing 114. Two terminal holes 321 and 322 are formed at an upper portion 320 of the housing 114.

The connection body 301 is made of a metal material, or the like, and air-tightly joined with the opening 310 of the housing 114 to form the opening 330 at a lower portion of the connection body 301, and the opening 330 of the connection body 301 and the upper plate 302 are air-tightly jointed.

As the connection body 301 and the upper plate 302 are air-tightly joined, the housing 114 has the air-tight space 340 accommodating the fixed contact point 111 and the movable contact point 112. An insulating gas containing hydrogen as a main ingredient is sealed in the air-tight space 340.

The respective fixed terminals 350 within the air-tight space 340 are formed of conductors, made of a copper-based material, or the like, and have the fixed contact point at a lower end thereof and a sun screen unit at an upper end thereof to allow an external device to be connected thereto. A movable contactor 360 is formed of a conductor such as a copper-based material, or the like, and formed to have a flat plate-like shape, and includes a movable contact point on an upper surface thereof. The movable contact point is integrally formed with the movable contactor 360.

Figure 4A:
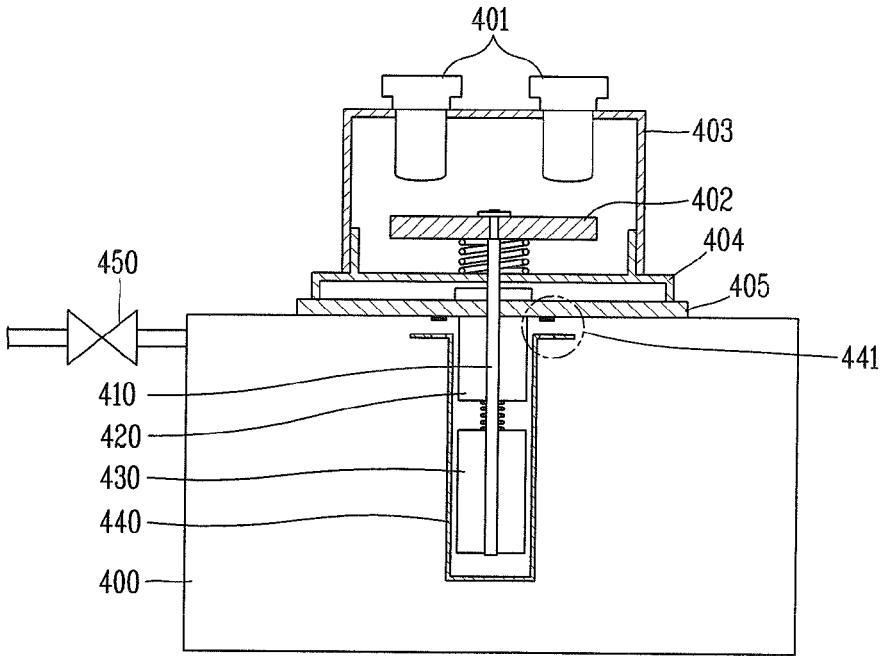
FIGS. 4A to 4C are views showing a structure for manufacturing the sealed contact points according to an embodiment of the present invention.
Figure 4B:
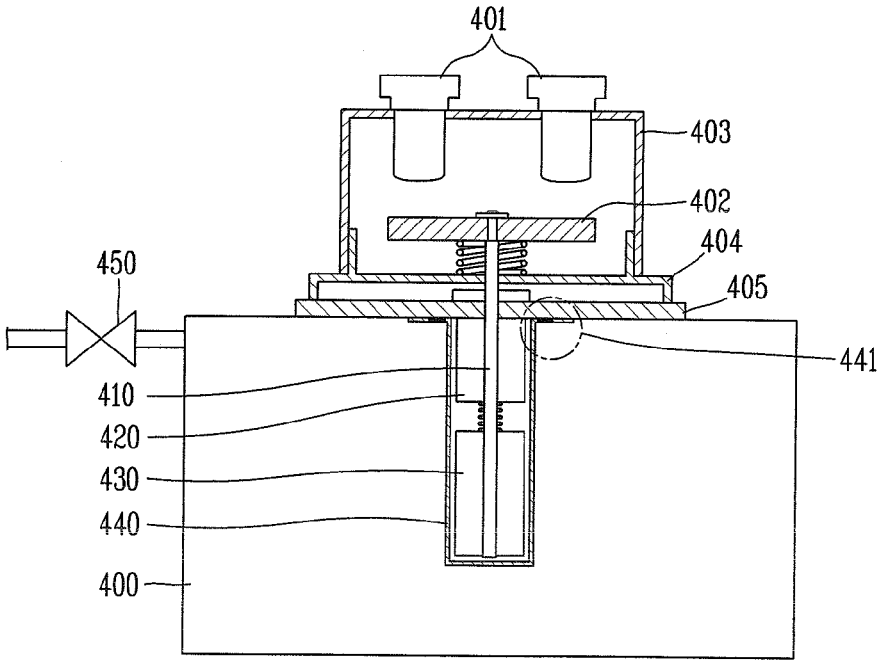
Figure 4C:
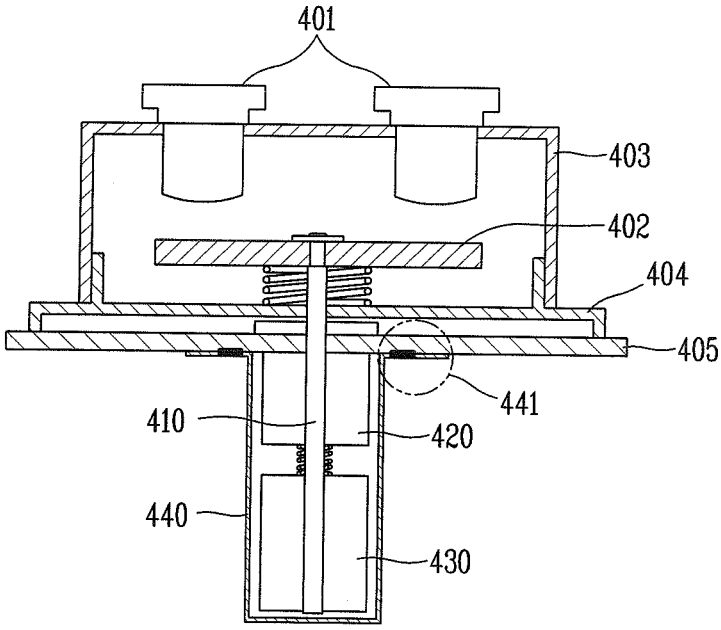

FIGS. 4A to 4C are views showing a structure for manufacturing the sealed contact points according to an embodiment of the present invention.

With reference to FIGS. 4A to 4C, in the contact point sealing structure, fixed contact points 401 and a movable contact point 402 are disposed in the space formed by coupling a housing 403, a connection body 404, and a plate 405.

The movable contact point 402 is connected with a shaft 410, and the shaft 410 is coupled with a movable iron core 403 through the connection body 404, the plate 405, and a fixed iron core 410 fixed at a lower portion of the plate 405. The shaft 410, the movable contact point 402, and the respective iron cores 420 and 430 are coupled to constitute a driving body. The housing 403, the connection body 404, and the plate 405 are joined to form an air-tight space in which the fixed contact points 401 and the movable contact point 402 are disposed.

A detachable chamber 400 is mounted to be air-tightly fixed at a lower portion of the plate 405 having the foregoing structure, and in this state, insulating gas is injected into the chamber 400 by using a gas pump 450. As the insulating gas, hydrogen ($H_2$) gas is largely used, or a mixture gas of hydrogen ($H_2$) and nitrogen ($N_2$), or the like, may also be used.

In order to allow the insulating gas to be easily injected into the internal space of an assembly (or coupled body formed by coupling the housing 403, the connection body 404, and the plate 405), the insulating gas may be injected by a certain pressure or higher (in general, about 2 atm). Here, the chamber may be vacuum-exhausted before the insulating gas is injected into the chamber 400, and when a mixture gas is used, the mixture gas may be injected into the chamber 400 or the respective gases may be separately, sequentially injected so that the mixture gas can be injected into the chamber 400.

When the interior of the chamber 400 is under the insulating gas atmosphere, the insulating gas is supplied through the shaft or core (or iron core) of the driving body exposed from a lower portion of the plate 405 so as to be injected into the space of the assembly.

In a state in which the interior of the chamber 400 is under the insulating gas atmosphere, a cylinder 440 receives the fixed iron core 420 and the movable iron core 430 coupled to the lower portion of the plate 405 and is fixedly coupled with the plate 405. As a result, the housing 403, the connection body 404, the plate 405, and the cylinder 440 are coupled to form the sealing structure (assembly).

A tight-attachment inducing member 441 is formed on a lower portion of the plate 405 in order to tightly attach the plate 405 and the cylinder 440 when the plate 405 and the cylinder 440 are coupled, thus forming a sealing structure. The tight-attachment inducing member 440 may have a shape of a circular rubber ring. A plurality of tight-attachment inducing member 440 may be mounted on a portion where the cylinder 440 may be coupled to the plate 405, or the tight-attachment inducing member 441 having a single circular structure having a size of about an outer diameter of the cylinder 440 may be mounted on the portion where the cylinder 440 may be coupled to the plate 405.

Within the chamber 400 under the hydrogen atmosphere, the shaft and core protruded from the lower portion of the plate 405 are inserted into the cylinder 440, and the tight-attachment inducing member 441 mounted on the plate 405 and the cylinder 440 are tightly attached. In this case, a surface protrusion may be formed on an end portion of the cylinder at the plate side. Accordingly, the tight-attachment inducing member 441 and the surface protrusion of the cylinder 440 are tightly attached to form a sealing structure.

After a certain time enough for the insulating gas to be injected into the internal space of the assembly has lapsed, the lower portion of the plate 405 and the cylinder 440 are tightly attached. In the state in which the plate 405 and the cylinder 440 are tightly attached to be coupled, the hydrogen gas is discharged from the chamber 440 under the hydrogen gas atmosphere, and the plate 405 and the air-tightly fixed chamber 400 are disassembled.

In the state in which the chamber 400 is disassembled, the lower portion of the plate 405, the periphery of the tight-attachment inducing member 441 of the cylinder 440 are air-tightly welded through laser welding, or the like. Namely, the periphery of the cylinder 440 tightly attached to the plate 405 is melted (or fused) and a gap is air-tightly welded so as to be sealed and packaged.

The air-tight space is filled with the insulating gas, and a driving unit including an electric actuator is coupled to the sealed and packaged assembly, thus completing an electromagnetic switching device. The electromagnetic switching device may be used as a DC power conversion device performing a function of supplying or cutting a DC current.

In the present invention, according to the electromagnetic switching device, a space for holding an arc extinguishing gas for extinguishing arc generated when a contact point of the electromagnetic switching device in an OFF state can be sealed.

In the present invention, according to the method for sealing the space without using a sub-material in generating the air-tight space of the electromagnetic switching device, the unit cost of the product can be lowered and the reliability of sealing can be enhanced.

As the present invention may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. A method for manufacturing a sealed contactor, the method comprising:

forming a driving body by coupling a movable contact point, a shaft, and a core, and coupling a housing and a plate to form an air-tight space in which the movable contact and a movable contact point are disposed;

air-tightly fixing a detachable chamber to a lower portion of the plate and forming an interior of the chamber under an insulating gas atmosphere;

inserting the shaft and a core of the driving body protruded from the lower portion of the plate into a cylinder within the chamber under the insulating gas atmosphere and tightly attaching the cylinder to the plate by a tight-attachment inducing member mounted at a lower portion of the plate to form a sealing structure;

exhausting the chamber; disassembling the chamber from the plate; and sealing the tightly attached plate and the cylinder.

2. The method of claim 1, wherein, in coupling the housing and the plate, the housing, a connection body fixing the housing, and the plate are coupled to the form the sealing structure.

3. The method of claim 1, wherein, in forming the interior of the chamber under the insulating gas atmosphere, the detachable chamber is air-tightly fixed to the lower portion of the plate in a state in which the protruded shaft and the core of the driving body are exposed, and an insulating gas is injected into the chamber in a vacuum state at a certain pressure.

4. The method of claim 3, wherein the insulating gas is hydrogen ($H_2$).

5. The method of claim 3, wherein the insulating gas is a mixture of hydrogen ($H_2$) and nitrogen ($N_2$).

6. The method of claim 3, wherein, in forming the interior of the chamber under the insulating gas atmosphere, the insulating gas is injected by using a gas pump connected to the chamber.

7. The method of claim 6, wherein, in forming the interior of the chamber under the insulating gas atmosphere, the interior of the chamber is exhausted to be vaccumized by the gas pump and then the insulating gas is injected into the chamber.

8. The method of claim 6, wherein, in the sealing, the plate and the cylinder are laser-welded in a state in which the chamber is disassembled.

9. The method of claim 1, wherein, in coupling the cylinder, within the chamber under the insulating gas atmosphere, the shaft and the core protruded from the lower portion of the plate are inserted into the cylinder, and the tight-attachment inducing member mounted on the plate and a surface protrusion formed on the cylinder is tightly attached to form the sealing structure.

10. The method of claim 9, wherein the tight-attachment inducing member has a form of a circular rubber ring.

11. The method of claim 10, wherein a plurality of tight-attachment inducing members are provided at a portion where the cylinder can be coupled to the plate.

12. The method of claim 1, wherein, in disassembling the chamber, in a state in which the plate and the cylinder are tightly attached and coupled, the insulating gas is discharged from the chamber under the insulating gas atmosphere, and the chamber air-tightly fixed to the plate is then disassembled.

* * * * *